United States Patent [19]

Ishiguro

[11] Patent Number: 4,919,085

[45] Date of Patent: Apr. 24, 1990

[54] PULSE COMBUSTION APPARATUS

[75] Inventor: Katsusuke Ishiguro, Nagoya, Japan

[73] Assignee: Paloma Kogyo Kabushiki Kaisha, Nagoya, Japan

[21] Appl. No.: 285,112

[22] Filed: Dec. 15, 1988

[30] Foreign Application Priority Data

Jun. 4, 1988 [JP] Japan ..... 63-137962

[51] Int. Cl.[5] ..... F22B 31/00

[52] U.S. Cl. ..... 122/24; 431/1

[58] Field of Search ..... 122/24; 431/1; 60/39.77

[56] References Cited

U.S. PATENT DOCUMENTS 4,259,928 4/1981 Huber ..... 122/24

4,759,312 7/1988 Pletzer ..... 122/24

FOREIGN PATENT DOCUMENTS 58-156105 9/1983 Japan .

58-158405 9/1983 Japan .

*Primary Examiner*—Edward G. Favors

*Attorney, Agent, or Firm*—Lahive & Cockfield

[57] ABSTRACT

A pulse combustion apparatus includes a hot water storage tank, a combustion chamber provided in the tank, a mixing chamber disposed outside the tank and connected to the combustion chamber, an air supply line comprising an air pipe, a fan, a muffler and an air chamber and connected to the mixing chamber, a fuel supply line connected to the mixing chamber, and an exhaust line connected to the combustion chamber. The muffler is disposed between the fan and the air chamber. The exhaust line includes a muffler disposed in the tank and connected to the combustion chamber by a tailpipe.

2 Claims, 5 Drawing Sheets

PULSE COMBUSTION APPARATUS

BACKGROUND OF THE INVENTION

1. Field of the Invention:

This invention relates to a pulse combustion apparatus which can be used effectively as a source of heat supply to, for example, a hot water supply system of the type in which heated water can be stored.

2. Description of the Prior Art:

There is known a pulse combustion apparatus having a combustion chamber in which a mixture of fuel gas and air repeats explosion and combustion in a pulsating way. This type of apparatus has, however, not been widely accepted for a number of reasons including the noise which results from its operation. A typical example of the known apparatus which has been proposed to solve the problem of noisy operation is shown in FIG. 7. It includes a muffler 2' provided between a fan F' and the top 1*a*'s of an air pipe 1' in an air supply line A'. It also includes a muffler E' provided in an exhaust line C'. The muffler E' is located near the outer end of an exhaust pipe 12' and outside a hot water storage tank D'. The muffler E' is cylindrical and is nothing but a diametrically enlarged portion of the exhaust pipe 12'.

The apparatus as shown in FIG. 7 is, however, not a satisfactory solution to the problem of noisy operation. The noise which results from pulsating combustion in a combustion chamber 7' is transmitted to the fan F' through an air chamber 3' and leaks out of the fan F'. The casing of the fan F' does not have a wall thickness which is sufficiently large to suppress the noise. The pulsating combustion which occurs in the combustion chamber 7' proceeds by repeating, say, 80 to 100 cycles of air suction, explosive combustion, expansion and exhaust per second. The resulting noise substantially leaks out through the wall of the casing of the fan F' before it reaches the muffler 2'. Accordingly, the muffler 2' has only a greatly reduced effect of absorbing the noise. It is also to be noted that the casing of the fan F' produces resonance. Therefore, it is impossible to remove the noise effectively from the air supply line of the apparatus. The muffler E' provided in the exhaust line C' also fails to show any satisfactory noise damping effect, as is obvious from the results of theoretical analysis of experimental data which will hereinafter be described.

Another drawback of the known apparatus resides in its low thermal efficiency. Only the combustion chamber 7' and a tailpipe 9' are provided in the hot water storage tank D' for exchanging heat with water. The water in the tank D', therefore, exhibits a substantially large loss of heat.

SUMMARY OF THE INVENTION

Under these circumstances, it is an object of this invention to provide a pulse combustion apparatus which is quiet in operation and has a high thermal efficiency.

This object is attained by a pulse combustion apparatus including a hot water storage tank, a combustion chamber provided in the hot water storage tank, a mixing chamber disposed outside the hot water storage tank and connected to the combustion chamber, an air supply line comprising an air pipe, a fan, a muffler and an air chamber and connected to the mixing chamber, fuel supply line connected to the mixing chamber, and an exhaust line connected to the combustion chamber, characterized in that the muffler is disposed between the fan and the air chamber, and that the exhaust line includes a muffler disposed in the hot water storage tank and connected to the combustion chamber by a tailpipe.

The muffler in the air supply line is provided between the fan and the air chamber. In other words, it is located near the combustion chamber and can, therefore, suppress effectively the noise resulting from pulsating combustion.

The muffler in the exhaust line is located in the water which the hot water storage tank contains, and can, therefore, suppress the noise effectively. This muffler may comprise an expansion chamber and a damping chamber which is connected to the expansion chamber by a throat. The muffler of this construction exhibits two successive steps of effectively nose damping.

According to this invention, therefore, it is possible to suppress effectively both the noise which is transmitted through the air supply line, and the noise which is transmitted through the exhaust line.

The combustion chamber, the tailpipe, the muffler in the exhaust line and a part of exhaust pipe are positioned in the water which the hot water storage tank holds. The heat of the combustion product can, therefore, be utilized effectively to keep the water in the tank at a satisfactorily high temperature.

Other features and advantages of this invention will be apparent from the following description and the accompanying drawings.

DETAILED DESCRIPTION OF THE INVENTION

Figure 1:
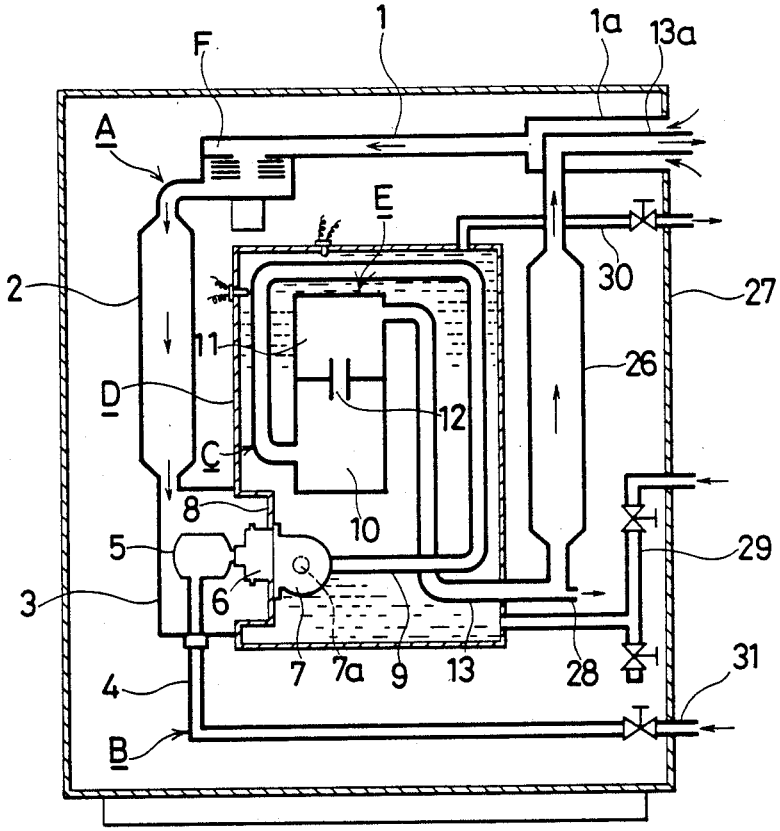
FIG. 1 is a schematic elevational view, partly in section, of a pulse combustion apparatus embodying this invention.
Figure 2:
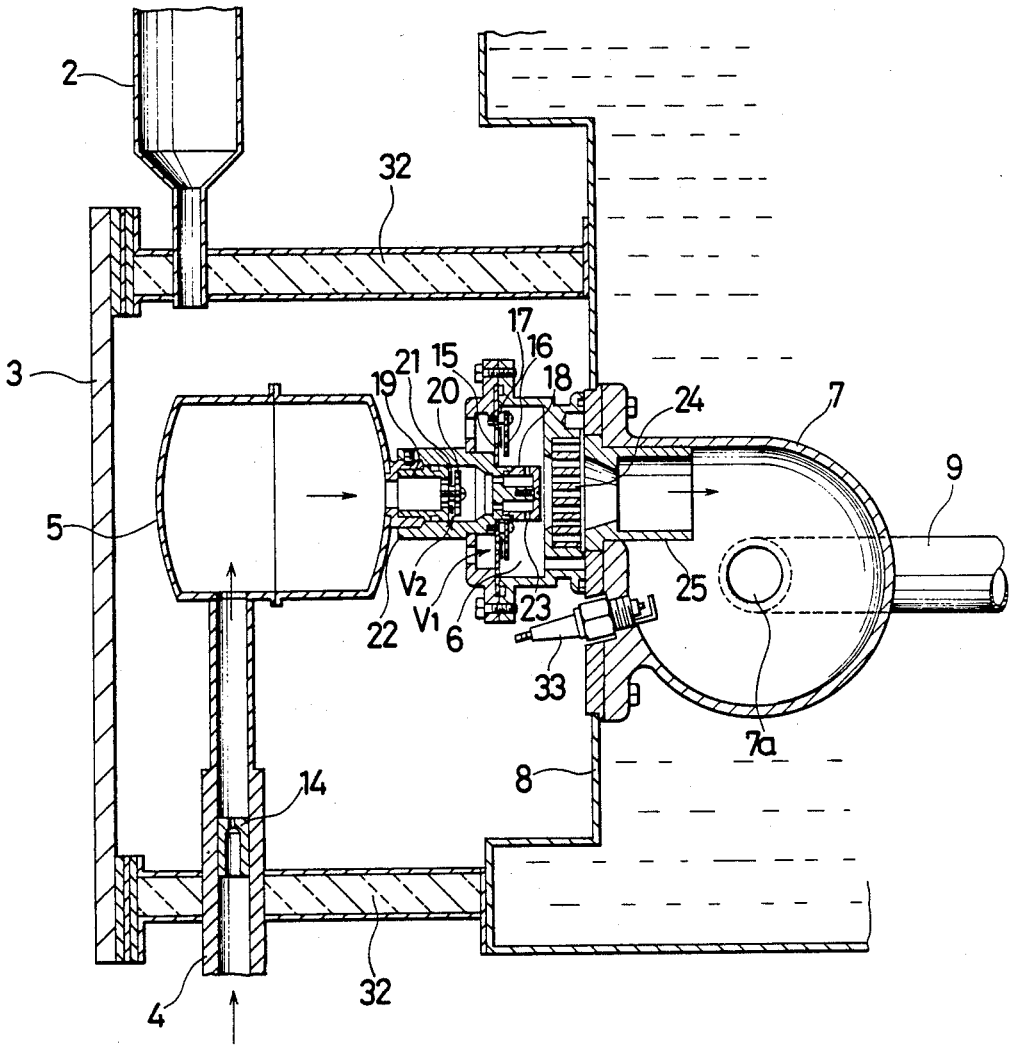
FIG. 2 is an enlarged vertical sectional view of a part of the apparatus shown in FIG. 1.

A pulse combustion apparatus embodying this invention is shown by way of example in FIG. 1 and 2. It includes an air supply line A which comprises an air pipe 1 having a top end 1*a* through which air is drawn into the air supply line A, a fan F, a muffler 2, an air chamber 3, and an air check valve $V_1$. The muffler 2 is provided between the fan F and the air chamber 3 for suppressing the noise resulting from pulsating combustion and propagating through the air supply line A. A fuel supply line B comprises a gas pipe 4, a gas chamber 5, a gas check valve $V_2$ and a gas distributor 18. The gas pipe 4 is provided with a main gas nozzle 14. The gas chamber 5 is positioned in the air chamber 3. The air and fuel supply lines A and B are both connected to a mixing chamber 6, as that fuel gas may be mixed with air.

The air check valve $V_1$ is located between the air chamber 3 and the mixing chamber 6. It comprises an air flapper valve 17 disposed between an air plate 15 and a back plate 16 lying in parallel to each other and having a small distance therebetween. The air flapper valve 17 is movable between the plates 15 and 16, so that it may be spaced apart from the air plate 15 to allow air to flow from the air chamber 3 to the mixing chamber 6 if the pressure of the air upstream of the mixing chamber 6 is higher than the pressure of exhaust gas downstream of the mixing chamber 6, while the air flapper valve 17 contacts the air plate 15 to interrupt the supply of air into the mixing chamber 6 if the reverse is the case.

The gas check valve $V_2$ and the gas distributor 18 are located between the gas chamber 5 and the mixing chamber 6. It comprises a gas flapper valve 21 disposed between two parallel valve seats 19 and 20 having a small distance therebetween. The gas flapper valve 21 is movable between the valve seats 19 and 20, so that it may be spaced apart from the valve seat 19 to allow fuel gas to flow from the gas chamber 5 to the mixing chamber 6 through the gas distributor 18 if the pressure of gas in the gas chamber 5 is higher than the pressure of exhaust gas, while the gas flapper valve 21 rests on the valve seat 19 to interrupt the supply of fuel gas int the mixing chamber 6 if the reverse is the case. The valve $V_2$ is situated in a gas nozzle housing 22 projecting from the gas chamber 5.

The gas distributor 18 is removable attached to that end of the gas nozzle housing 22 which is remote from the gas chamber 5. The gas distributor 18 is located in the mixing chamber 6 and has a plurality of nozzle openings 23 through which fuel gas is allowed to flow into the mixing chamber 6. The pulse combustion apparatus can be used to burn various kinds of fuel gases having different burning rates, e.g. fuel gas having a relatively low burning rate, such as propane or butane gas, fuel gas having a relatively high burning rate, such as natural gas, and fuel gas having a very high burning rate, such as hydrogen gas, if the position of the gas distributor 18 in the mixing chamber 6 and the positions of the nozzle openings 23 are appropriately altered.

A combustion chamber 7 is provided in a hot water storage tank D for burning a mixture of fuel gas and air which is supplied from the mixing chamber 6. The tank D has a sidewall 8 having an inner surface on which a housing defining the combustion chamber 7 is supported. The mixing chamber 6 is located on the opposite side of the sidewall 8 from the combustion chamber 7 and is fluidically connected to the combustion chamber 7. A flame trap 24 and a combustion chamber head (nozzle pipe) 25 are disposed between the mixing and combustion chambers 6 and 7. The flame trap 24 is of the heat resistant perforated plate construction and is provided for rectifying the flow of the fuel-air mixture and preventing backfire. The combustion chamber head 25 is situated at the inlet of the combustion chamber 7 and has an outlet so positioned in the combustion chamber 7 as to promote the flow of the fuel-air mixture into the combustion chamber 7, while preventing a flame from entering the combustion chamber head 25.

An exhaust line C includes a tailpipe 9 having one end connected to the outlet 7*a* of the combustion chamber 7. A muffler E is connected to the other end of the tailpipe 9. The muffler E has an expansion chamber 10 and a noise damping chamber 11 which is connected to the expansion chamber 10 by a throat 12 provided in the center of the muffler E. The tailpipe 9 is connected to the expansion chamber 10. An exhaust pipe 13 has one end connected to the damping chamber 11 of the muffle E. The tailpipe 9, the muffler E and a part of the exhaust pipe 13, as well as the combustion chamber 7, are mounted in the hot water storage tank D and define a heat exchanger for heating the water in the tank D and maintaining it at an elevated temperature. The exhaust pipe 13 projects outwardly from the tank D. The exhaust line C also includes a secondary muffler 26 provided in that portion of the exhaust pipe 13 which is located outside the tank D. Accordingly, the muffler E in the tank D may be referred to as the primary muffler in the exhaust line C. The exhaust pipe 13 has a top 13*a* situated within the top 1*a* of the air pipe 1 coaxially therewith. The tops 1*a* and 13*a* are both open to the exterior of a housing 27. A drain 28 is provided at the bottom of the exhaust pipe 13 below the muffler 26.

The apparatus also includes a pipe 29 for supplying water to the hot water storage tank D, a pipe 30 for delivering hot water from the tank D, and a pipe 31 for supplying fuel gas to the gas supply line B. The air chamber 3 has a top and a bottom wall which are both filled with sand 32, as shown in FIG. 2. The sand 32 provides an improved vibration-damping effect. The combustion chamber 7 is provided with a spark plug 33.

Although the check valves $V_1$ and $V_2$ have been described as being provided in the air and fuel supply lines A and B, respectively, as shown in FIG. 2, they can be replaced by other means that are equally effective for preventing the back flow of the combustion products.

In operation, fuel gas is supplied through the pipe 31 and the main gas nozzle 14 in the pipe 4 into the gas chamber 5 in which its pressure is equalized, and the fuel is, then, supplied into the mixing chamber 6 through the check valve $V_2$, the nozzle housing 22 and the gas distributor 18. On the other hand, air is supplied through the pipe 1, the fan F and the muffler 2 into the air chamber 3 in which its pressure is equalized, and the air is, then, supplied into the mixing chamber 6 through the check valve $V_1$. The fuel and air are mixed in the mixing chamber 6 to form a fuel-air mixture. During the beginning of operation, the fuel-air mixture is forced into the combustion chamber 7 by the action of the fan F and is ignited by the spark plug 33. When some time has passed, however, the fan F is stopped and the spark plug 33 is turned off. Thereafter, the apparatus is self-aspirating due to the negative pressure created in the combustion chamber and is self-igniting due to the heat of the combustion product. It continues automatic combustion by repeating, say, 80 to 100 cycles of fuel and air suction, combustion, expansion and exhaustion per second. The combustion product is exhausted from the combustion chamber 7 to the exterior of the housing 27 through the exhaust line C. The apparatus, therefore, realizes a high load of combustion and a high degree of heat conduction.

According to a salient feature of the invention, there does not occur any resonance of the fan F with the noise resulting from pulsating combustion, of any leakage of the noise through the fan F, as the muffler E which is provided in the air supply line A is situated sufficiently close to the source of the noise. Thus, the apparatus realizes a drastic reduction in the noise which is transmitted from the combustion chamber 7 to the air supply line A. TABLE 1 shows the results of the test which was conducted for determining the reduction of noise which could be achieved by the apparatus of this invention. As is obvious therefrom, the noise of the combustion chamber was reduced by 35 dB (A), and finally by additional 4 dB (A), making a total reduction of 39 dB (A).

TABLE 1

| | Intensity of noise dB (A) |
|---|---|
| Noise of combustion chamber | 95 |
| Noise of perceived from the apparatus of the invention | 60 |
| Noise perceived after final muffler and housing installation | 56 |

Figure 3:
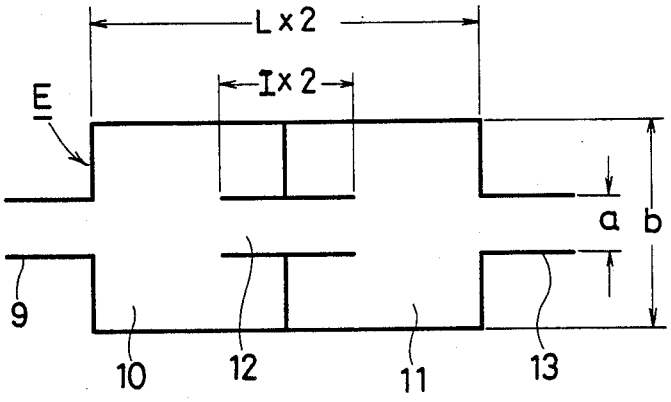
FIG. 3 is a diagrammatic view of a muffler for an exhaust line as employed for a noise damping test.
Figure 4:
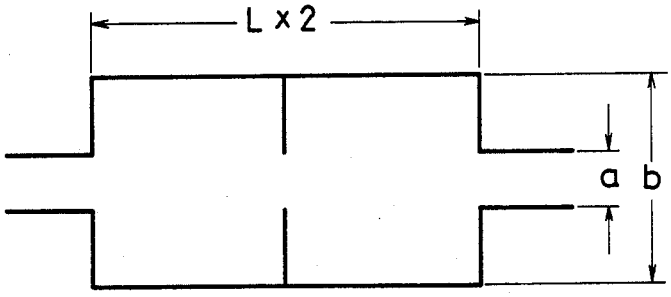
FIG. 4 is a view similar to FIG. 3, but showing a muffler departing from the scope of this invention.
Figure 5:
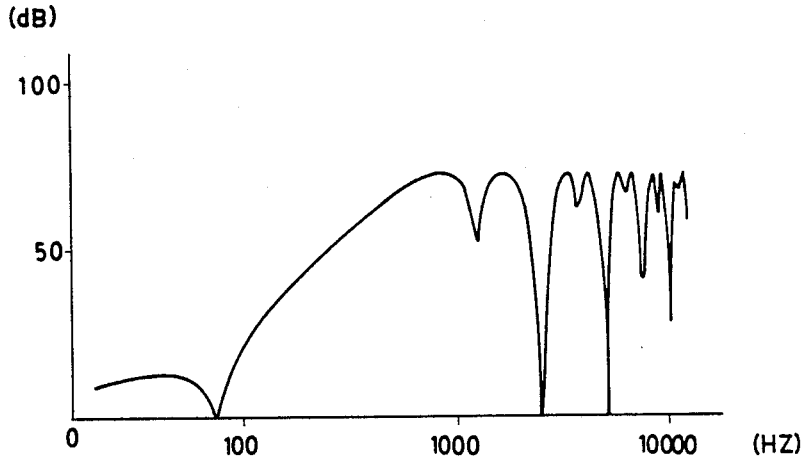
FIG. 5 is a graph showing the noise damping characteristics of the muffler shown in FIG. 3.
Figure 6:
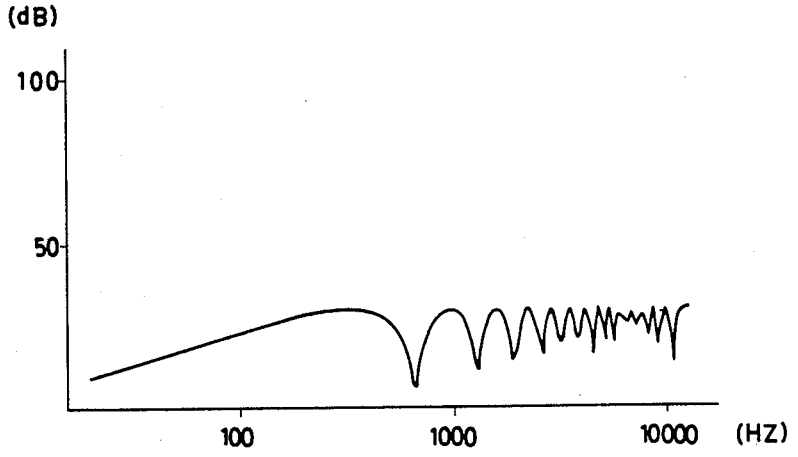
FIG. 6 is a graph showing the noise damping characteristics of the muffler shown in FIG. 4.
Figure 7:
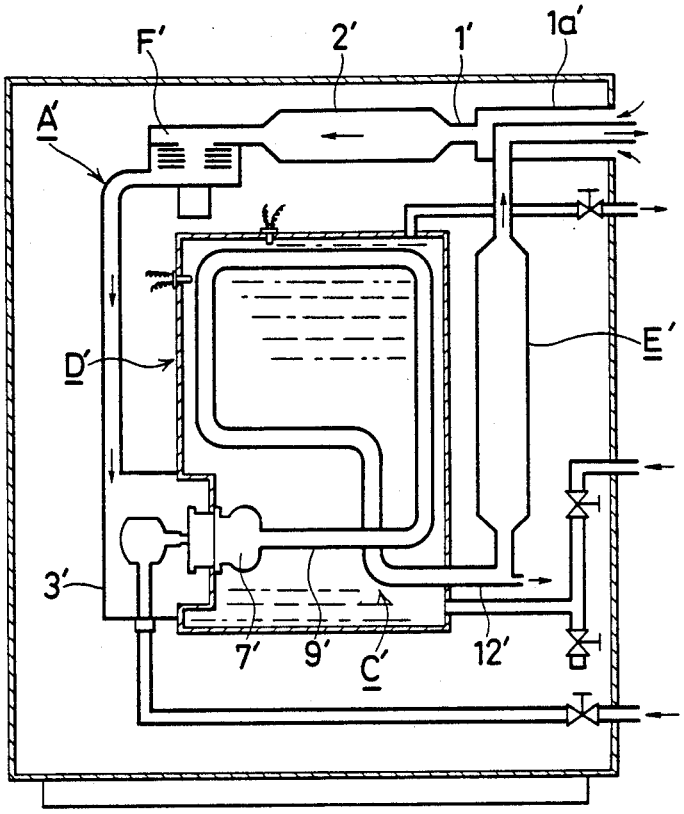
FIG. 7 (PRIOR ART)
FIG. 7 is a view similar to FIG. 1, but showing the known apparatus.

The noise which is transmitted from the combustion chamber 7 to the exhaust line C is effectively damped by the muffler E which is of the specific construction as hereinabove described, and which is, moreover, located in the hot water storage tank D. The remarkable damping effect of the muffler E according to this invention will now be described, with reference to FIGS. 3 to 6 and TABLES 2 and 3. FIG. 3 shows the muffler E which was compared with a comparative muffler as shown in FIG. 4. The comparative muffler was of the same volume with the muffler E of this invention, but was of the same construction therewith, except that the throat 12 was omitted from the comparative muffler. The noise damping characteristics of each of the two mufflers were obtained by calculation based on experimental data. The characteristics of the muffler E are shown in FIG. 5 and TABLE 2, and those of the comparative muffler in FIG. 6 and TABLE 3.

As is obvious therefrom, the muffler E of FIG. 3 realized a noise reduction of 67 dB in the vicinity of a frequency of 500 Hz which was typical of the noise resulting from pulsating combustion, while the comparative muffler of FIG. 4 could achieve only a reduction of about 26 dB. These results confirm the drastic noise damping effect of the muffler E having the throat 12 and placed in the space enclosed by water, as compared with the muffler located in the open air.

The dimensions as indicated in FIGS. 3 and 4 of the mufflers which were experimentally employed were as follows:

a = 3.2 cm; b = 25 cm; L = 17.5 cm; and I (FIG. 3) = 8.75 cm.

Both of the mufflers were tested at a gas temperature of 200° C.

TABLE 2

| Frequency (Hz) | Intensity of noise reduced (dB) | Frequency (Hz) | Intensity of noise reduced (dB) |
|---|---|---|---|
| 20 | 9.25599 | 160 | 38.2988 |
| 25 | 10.6444 | 200 | 44.7478 |

TABLE 2-continued

| Frequency (Hz) | Intensity of noise reduced (dB) | Frequency (Hz) | Intensity of noise reduced (dB) |
|---|---|---|---|
| 31.5 | 11.8712 | 250 | 50.7571 |
| 40 | 12.6401 | 315 | 56.6036 |
| 50 | 12.3252 | 400 | 62.2108 |
| 63 | 8.88625 | 500 | 66.9056 |
| 80 | 6.41089 | 630 | 70.9017 |
| 100 | 21.4066 | 800 | 73.3952 |
| 125 | 30.3186 | 1000 | 72.5583 |
| 1250 | 58.0774 | 5000 | 41.0244 |
| 1600 | 72.7442 | 6300 | 69.0438 |
| 2000 | 69.8223 | 8000 | 49.336 |
| 2500 | 14.141 | 10000 | 59.1958 |
| 3150 | 69.0753 | 12500 | 64.2242 |
| 4000 | 66.2712 | | |

TABLE 3

| Frequency (Hz) | Intensity of noise reduced (dB) | Frequency (Hz) | Intensity of noise reduced (dB) |
|---|---|---|---|
| 20 | 9.8913 | 500 | 26.0716 |
| 25 | 11.659 | 630 | 8.67944 |
| 31.5 | 13.5433 | 800 | 26.3074 |
| 40 | 15.5245 | 1000 | 29.6033 |
| 50 | 17.3884 | 1250 | 16.293 |
| 63 | 19.3166 | 1600 | 29.6626 |
| 80 | 21.2891 | 2000 | 18.8005 |
| 100 | 23.0918 | 2500 | 22.0391 |
| 125 | 24.8269 | 3150 | 21.7497 |
| 160 | 26.6142 | 4000 | 24.415 |
| 200 | 28.0307 | 5000 | 27.2276 |
| 250 | 29.1291 | 6300 | 26.9945 |
| 315 | 29.686 | 8000 | 28.9022 |
| 400 | 29.0798 | 10000 | 29.6163 |
| | | 12500 | 28.2607 |

What is claimed is:

1. A pulse combustion apparatus comprising (a) a hot water storage tank, (b) a combustion chamber provided in the tank, (c) an air and fuel mixing chamber disposed outside the tank and connected to the combustion chamber, (d) an air supply line having an air pipe, a fan, a first muffler and an air chamber which is connected to the mixing chamber, the first muffler being located between the fan and the air chamber, (e) a fuel supply line connected to the mixing chamber, (f) an exhaust line connected to the combustion chamber and having a greater part within the tank, the exhaust line including a second muffler which is located within the tank and comprises an expansion chamber and a noise damping chamber, (g) a throat making the expansion chamber communicate with the noise damping, and (h) a tailpipe connecting the combustion chamber to the expansion chamber.

2. The apparatus of claim 1 further comprising a housing which encloses all said parts of the apparatus.

* * * * *

UNITED STATES PATENT AND TRADEMARK OFFICE

CERTIFICATE OF CORRECTION

PATENT NO. : 4,919,085

DATED : April 24, 1990

INVENTOR(S) : Katsusuke Ishiguro

It is certified that error appears in the above-identified patent and that said Letters Patent is hereby corrected as shown below:

Column 3, line 25, replace "int" with --into--.

Signed and Sealed this

Fourth Day of February, 1992

*Attest:*

HARRY F. MANBECK, JR.

*Attesting Officer*

*Commissioner of Patents and Trademarks*